United States Patent [19]

Degraeve et al.

[11] 4,216,838

[45] Aug. 12, 1980

[54] COMPACTING APPARATUS FOR ROAD SURFACING MATERIAL

[75] Inventors: François R. Degraeve, Pont Ste-Maxence; René G. Divay, Nogent-sur-Oise; Jean-Pierre E. Lecoeur, Liancourt, all of France

[73] Assignee: Albaret S.A., Rantigny, France

[21] Appl. No.: 864,792

[22] Filed: Dec. 27, 1977

[30] Foreign Application Priority Data

Dec. 28, 1976 [FR] France ..... 76 39224

[51] Int. Cl.[2] ..... E01C 19/00

[52] U.S. Cl. ..... 180/14 R; 74/545; 172/25; 180/79; 404/84

[58] Field of Search ..... 180/14 R, 14 D, 79, 180/7 R, 2, 20; 404/84, 112, 122, 102, 103, 127, 128; 172/25; 74/545; 272/29, 28 R, 33 B

[56] References Cited

U.S. PATENT DOCUMENTS

| | | | |
|---|---|---|---|
| 2,259,193 | 10/1941 | Andrew | 172/25 |
| 3,130,794 | 4/1964 | Lovell | 172/25 |
| 3,273,664 | 9/1966 | Ramer | 180/79 |
| 3,964,834 | 6/1976 | Paramythioti | 404/84 |

FOREIGN PATENT DOCUMENTS

| | | | |
|---|---|---|---|
| 1964708 | 12/1970 | Fed. Rep. of Germany | 180/14 D |
| 857834 | 1/1961 | United Kingdom | 180/79 |
| 909533 | 10/1962 | United Kingdom | 180/79 |

*Primary Examiner*—John P. Silverstrim
*Attorney, Agent, or Firm*—Charles E. Brown

[57] ABSTRACT

Apparatus for compacting or consolidating a strip of road surfacing material essentially comprises a self-propelled compacting machine and a guide vehicle. The guide vehicle has a steerable wheel and a set of drive wheels. The compacting machine is guided for orbital movement around the guide vehicle at a preset turning radius. The guide vehicle may be self-propelled in which case it carries its own motor for driving its driving shaft. Preferably the guide vehicle is driven for progressive displacement along the strip of surfacing material in response to the turning of a coupling bar, connecting the compacting machine with the guide vehicle about its end for determining the turning radius of the former. The coupling bar in turn rotatably drives the driving shaft of the guide vehicle which in turn drives the drive wheels of the guide vehicle through a power transmission. The guide vehicle is provided with a steering mechanism controlled by a steering control system including a lateral position sensing device disposed on the compacting machine which is connected through an electrically control circuit to operate an electromagnet, for example, for changing the position of the steering mechanism from one limit position to an opposed limit position once the compacting machine gets too close to an edge or the strip being compacted.

8 Claims, 10 Drawing Figures

COMPACTING APPARATUS FOR ROAD SURFACING MATERIAL

U.S. Pat. No. 3,964,834 issued on June 22, 1976 to the assignee of the present application already disclosed apparatus for compacting or consolidating a strip of roadsurfacing composition which is characterized by the fact it is made up of two distinct machines or vehicles, i.e., a self-propelled compacting machine and a guide vehicle, the compacting machine having its steering mechanism automatically controlled by sensing means adapted to coact with a guide member carried by the guide vehicle and thereby automatically steered for orbital movement around the same.

According to this patent it is contemplated to make the guide vehicle a towed vehicle having a hitching beam for coupling it to any kind of tractive vehicle; this arrangement is of special interest where the tractive vehicle is a spreading machine or finisher which previously spreads a layer of read surfacing material to be compacted or consolidated.

This apparatus has given and continues to give satisfaction.

Still, the turning radius of the compacting machine is, which is sometimes bothersome, limited by the hitching beam of the guide vehicle and/or the beam on the tractive vehicle to which it is hitched, the compacting machine having to pass beneath the hitching beam and/or the beam of the tractive vehicle.

In addition, when, as mentioned, the tractive vehicle is the spreading machine itself, another problem may arise. The most commonly used spreading machines spread or lay roadsurfacing material at rates greater than supply trucks are able to supply the same to a storage bin for the spreading machine. Consequently the spreading machine operates intermittently; as long as the storage bin is kept supplied by trucks, and optionally through the intermediary of a hopper which moves synchronously therewith, and thus contains surfacing material, it is possible to continue laying the same; conversely, once there is an interruption in the supply to the storage bin, the laying of surface material must be stopped.

The interrupted operation which inevitably affects the guide vehicle guiding the associated compacting machine since it is towed by the spreading machine, is not consonant with uniform compaction of the surfacing material and substantially diminishes the hourly production rate of the compacting machine owing to the frequent stoppages imposed on the same.

The object of the present invention is to free the spreading machine from the operation of compacting or consolidating and, more generally, to free the guide vehicle from being towed by any tractive vehicle.

For the purpose it is contemplated to make the guide vehicle, around which the compacting machine turns, a self-contained unit apart from its association with the compacting machine for guiding the latter in orbital movement.

According to a first embodiment of the invention, the guide vehicle is equipped with its own motor and therefore is self-propelled.

Yet in accordance with a preferred embodiment of the invention, for the driving of the guide vehicle it is provided with a vertical driving shaft and a power transmission disposed between the driving shaft and a wheel axle; between the compacting machine and the guide vehicle there is provided a coupling bar which, on the one hand, is adapted to be driven by the compacting machine in the course of its movement around the guide vehicle and, on the other hand, is adapted to be keyed for rotation with the driving shaft on the guide vehicle.

Thus the mere orbital movement of the compacting machine around the guide vehicle produces the progressive linear movement of the guide vehicle.

This arrangement has a dual advantage: it is particularly economical and it enables the automatic control of the progressive movement of the guide vehicle with the number of compacting passes of the compacting machine which favors uniform compaction.

It also enables an especially simplified connection between the guide vehicle and the directional control of the compacting machine. Indeed, and although this association may be in accordance with the aforementioned U.S. patent, it may be of very simple construction comprising a crank forming a sensing member mounted rotatably on the compacting machine and articulated on the coupling bar which at the other end is attached to the guide vehicle thus constitutes the guide member with which the sensing member is associated.

Finally, the arrangement embodying the invention also facilitates the association, for improved production rates of the apparatus, of a plurality of compacting machines with a single guide vahicle, the speed controls of the compacting machines preferably being coupled to one of them.

These and other features and advantages of the invention will become more apparent from the description which follows, given by way of example, with a reference to the accompanying diagrammatic drawings, in which.

Figure 1:
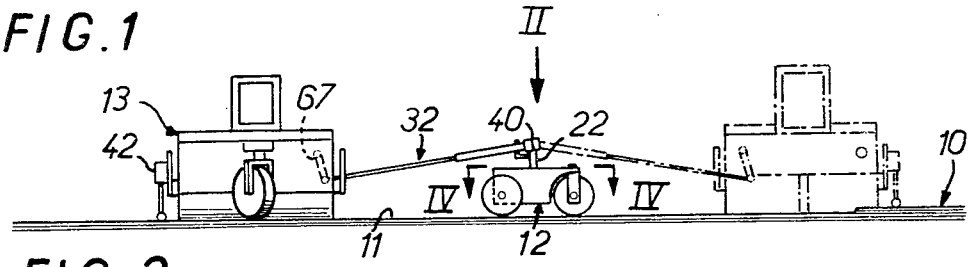
FIG. 1 is an elevation view of a compacting or consolidating apparatus embodying the present invention.
Figure 2:
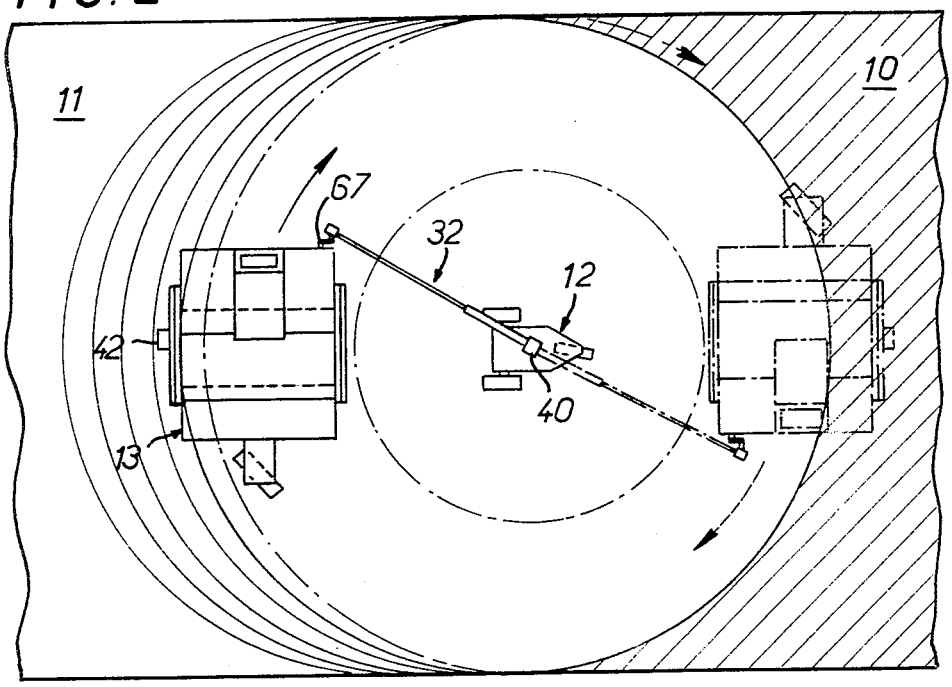
FIG. 2 is a top plan view of the compacting or consolidating apparatus shown in FIG. 1.

FIGS. 1 and 2 diagrammatically illustrated a continuous strip of surfacing material to be compacted or consolidated, freshly laid on a road bed 11 in the process of construction; the material is, for example, asphalt.

As described in the aforementioned U.S. patent the compaction or consolidation of the surfacing material is effected by means of a compacting or consolidating apparatus comprising, in combination, two separate vehicles, viz., a guide vehicle 12 and a compacting machine 13 in orbital motion about the guide vehicle, the steering of the compacting machine being controlled by a sensing means adapted to cooperate with a guide member carried by the guide vehicle.

The compacting machine 13 is of conventional construction and therefore will not be described in detail herein.

According to the invention the guide vehicle 12, apart from its associated with the compacting machine 13, is independent and self-contained, that is, for its displacement generally along the axis of the strip 10 of road surfacing material to be compacted it is not towed by any tractive vehicle.

In accordance with the illustrated embodiment, the guide vehicle 12 has a boxlike body 18 which rolls on the ground on a set of drive wheels 19, and a steerable wheel 20. For driving the guide vehicle it is provided with a vertical driving shaft 22 rotatably mounted on the body 18 and a power transmission 23 provided between the vertical driving shaft 22 and the axle 24 for its set of drive wheels 19.

In the illustrated embodiment the power transmission 23 comprises a plate member 25 keyed to the vertical driving shaft 22 and urged resiliently by a spring 26 in contact with a follower 27 which is keyed for rotation with a shaft 28 parallel with the axle 24 and connected for rotation with the same by sprockets 29 and a chain 30.

Figure 4:
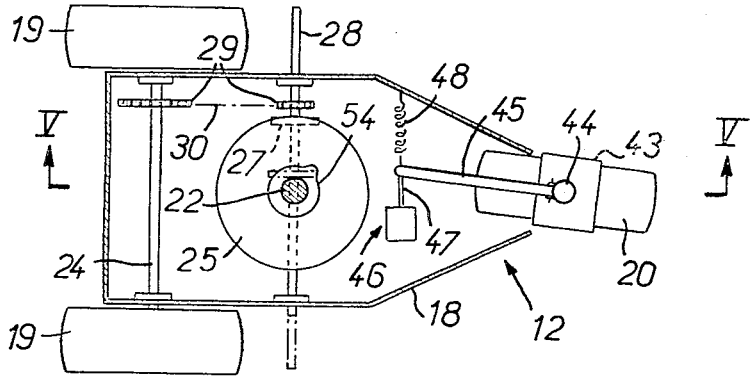
FIG. 4 is a sectional view, on an enlarged scale, of the guide vehicle, taken on the line IV—IV in FIG. 1.

Preferably, and as diagrammatically represented in chain dotted lines in FIG. 4, the shaft 28 carrying follower 27 is adjustable in position on the body 18 so that by engagement of the plate member 25 at different radial distances on the periphery of the follower it is possible to vary the reduction ratio imparted by the power transmission between the driving shaft 22 and the axle 24 for the set of drive wheels 19; the transmission itself therefore constitutes a speed variator or positive infinitely variable drive.

In order to drive the vertical drive shaft 22 for rotation, a coupling bar 32 is provided between the guide vehicle 12 and the compacting machine. Alternatively, the driving shaft may be coupled to the output shaft of independent motor means mounted on the guide vehicle (not shown) in which case the guide vehicle is self-propelled.

In the illustrated embodiment the coupling bar 32 is telescopic and thus made up of two or more members 33 slidably mounted relative one another and provided with releasable locking means, such as a set screw 34 adapted to fix the length thereof.

The guide vehicle end of the coupling bar 32 is in contact with horizontal support means and vertical abutment means, and the driving shaft 22 on the guide vehicle carries a crank 37 having a right-angled leg interposed along the path of travel of the coupling bar 32 about the driving shaft 22.

Preferably, the coupling bar 32 is linked to the driving shaft 22 of the guide vehicle 12 by coupling joint means permitting freedom of rotation of the coupling bar at least in the horizontal plane perpendicular to its extendable direction. In practice, the coupling joint means comprises a ball member 39 carried at the end of the driving shaft 22, the corresponding end member 33 of the coupling bar 32 carrying a socket member 40 which constitutes a ball joint with the ball member 39.

The ball joint coupling means forms, on its own, a horizontal support means and a vertical abutment means for the coupling bar 32, the vertical abutment means necessarily being there for conferring support for the coupling bar when it abuts against the crank 37 carried by the driving shaft 22 on the guide vehicle 12.

At the compacting machine end the coupling bar 32 is articulated to a crank 67 which is rotatably mounted on the compacting machine and defines the sensing means for controlling the steering thereof; the coupling bar 32 which carries a socket member 68 in ball-and-sockwet engagement with a ball member 69 on the crank 67 which of course is fixed in length, thereby constitutes by itself the guide member with which the sensing means is associated.

For example, in accordance with the aforementioned U.S. patent, the crank 67 may actuate one of two electrical contacts connected to the power supply for a motor which controls the compacting machine steering direction or may be coupled to the movable contact of adjustable resistor or rheostat which controls the steering direction. If the turning radius tends to get smaller the coupling bar 32 of preset length pushes the crank 67 to pivot outwards, the resultant action causing the direction of movement of the compacting machine to increase the turning radius. Conversely, if the turning radius increases, the coupling bar 32 pivots the crank 67 in the opposite direction, pulling the same, thus causing a decrease in the turning radius.

Moreover, it will be easily understood that when the compacting machine 13, which is self-propelled moves around the guide vehicle 12 it rotates the coupling bar 32 about an end thereof; this end of the coupling bar adjacent the guide vehicle 12, bearing on the driving shaft 22, causes in turn the rotation of the driving shaft when the coupling bar abuts against the crank 37.

By the turning of the compacting machine 13 about the guide vehicle 12 there is automatically produced a translatory movement of the entire compacting apparatus: for example, for a linear speed of progression of 3 km/h of the compacting machine, the speed of the guide vehicle will advantageously be between 0.5 and 3 m per minute, bearing in mind that the distance covered by the guide vehicle depends only on the number of revolutions of the compacting machine for a given transmission ratio, and not on the distance covered by the compacting machine, and therefore the speed of the guide vehicle is proportional to the angular velocity of the compacting machine and not the speed of linear progression thereof.

For its steering control the guide vehicle 12 is equipped with a steering mechanism, and in accordance with the features which will now be described, the steering mechanism is controlled by a lateral position sensing device 42 which is disposed on the side of the compacting machine 13. To accomplish this, and in conformity with a particular embodiment of the invetion, the steering mechanism of the guide vehicle 12 is displaceable between limit positions respectively to each side of an intermediate or central position for straight line displacement of the guide vehicle.

Figure 5:
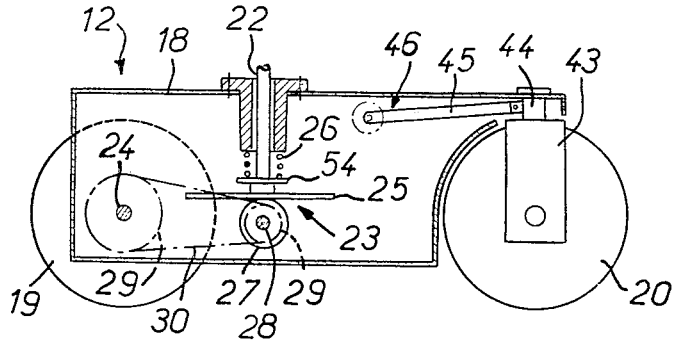
FIG. 5 is an axial cross section of the guide vehicle, taken on the line V—v in FIG. 4.
Figure 6:
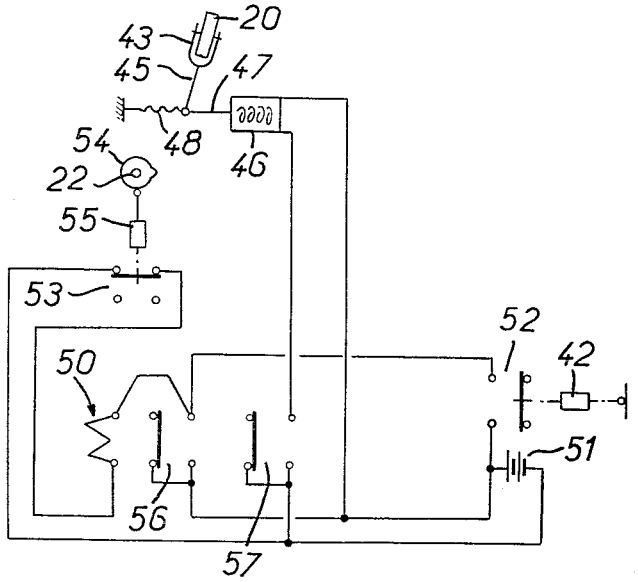
FIG. 6 is a circuit diagram illustrating the steering system of the guide vehicle with a position sensing device carried on the compacting machine.

In the illustrated embodiment of FIGS. 4–6, the yoke 43 on which the steerable wheel 20 of the guide vehicle is rotatably mounted, is keyed to a vertical pintle 44 which in turn is supported on a link 45 at the end of which is provided drive means 46. The drive means 46 is a single-acting electromagnetic having a plunger core 47 attached to the link 45 of the steering mechanism of the steerable wheel 20. The link 45 is constantly urged by a spring 46 to a position in which it imparts a predetermined turning radius on the steerable wheel 20, for instance, sharply towards the right, as illustrated.

As shown in the circuit diagram of FIG. 6, the electromagnet 46 is supplied by a current source, e.g., a battery 51 as shown, and controlled by a relay 50. Interposed in series in the circuit between the battery 51 and the relay 50 are a switch 52 controlled by lateral position sensing device 42 carried by the compacting machine 13, and a switch 53 operated by a rotary cam 54 through a switch actuator 55, the cam 54 being rotatably mounted on the guide vehicle 12 and controlled for rotation by the compacting machine 13 synchronously with the turning movement of the compacting machine about the guide vehicle.

In practice, such as illustrated in FIGS. 5 and 6 the rotary cam 54 is keyed for rotation with the driving shaft 22 on the guide vehicle.

A holding switch contact 56 is also associated with the relay 50. The relay 50 actuates a switch contact 57 interposed in the supply line for the electromagnet embodying the drive means 46.

The operation of the steering control system for the guide vehicle will now be described.

Figure 7:
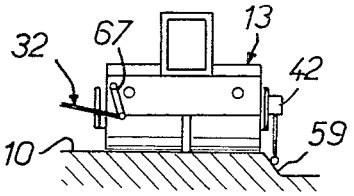
FIG. 7 is an elevational view of the compacting machine showing the operation of the position sensing device provided thereon.

First of all it will be assumed that the switch contact 53 is in its closed position and contrariwise the switch contact 52 is in its open position which switch contact is operated by the lateral position sensing device 42 which touches the ground in the immediate vicinity of the compacting machine 12 when the compacting machine 13 is at a distance from the substantially vertical drop or step 59 the strip of surfacing material to be compacted makes with the already compacted surfacing material, at the right in FIG. 7. The relay 50 is not energized nor is the electromagnet 46.

Consequently, under the force of the spring 48, the steerable wheel 20 of the guide vehicle 12 is in its limit position described above, in which it imparts a preset turning radius, towards the right, to the guide vehicle. The path of movement of the guide vehicle then comes close to the right edge of the strip of material 10 to be compacted, as schematically represented by the chain-dotted line I in FIG. 8.

The situation remains unchanged until, in the course of its turning movement about the guide vehicle 12, the compacting machine 13 comes so close to the right edge or margin of the strip 10 that the lateral position sensing device 42 comes into alignment with the vertical step or drop 59 at the edge of the strip being compacted thereby actuating its association switch contact 52 to its closed position.

The relay 50 is then energized and owing to its holding contact 56 remains temporarily in this position regardless of any subsequent change in position of the switch contact 52 response to the position sensing device.

Figure 8:
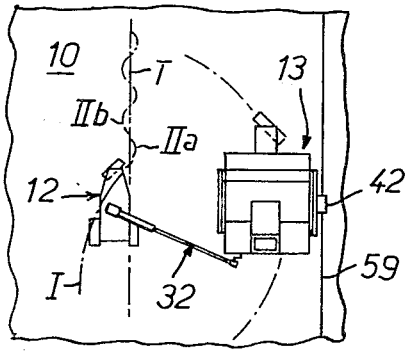
FIG. 8 is a plan view showing the operation of the steering control system for the compacting machine.

The switch contact 57 of the relay 50 controls, in turn, the energization of the electromagnet 46 which then controls the movement of the steerable wheel 20 from its previous limit position to its opposed limit position in which a predetermined turning radius is imparted to the guide vehicle 12, to the left, whereby the guide vehicle 12, following its path of movement represented schematically by chain-dotted line II*a* in FIG. 8, moves away from the right-hand edge of the strip 10 of material being compacted.

In the course of the turning movement of the compacting machine 13 immediately thereafter the cam 54 operated by the compacting machine 13 through switch operator 55 causes the temporary opening of the associated switch contact 53 which instantaneously de-energizes the relay 50, and its associated switch contacts 56 and 57 revert to their open position. As the electromagnetic 46 is no longer energized, the spring 48 urges the steerable wheel 20 to its first limit position imparting a path of movement schematically represented by chain-dotted line II*b* in FIG. 8, the guide vehicle once again moves towards to right-hand edge of the strip 10.

The foregoing procedure is repeated periodically, the guide line T of which is substantially parallel to the right-hand edge of the strip 10 to be compacted.

By an appropriate selection of the initial length of the telescopic coupling bar 32 described above, the length thereof may be adjusted, (alternatively, however, the coupling bar may be of fixed length and consist of a single member), and the center line of the sinusoidal path of travel of the guide vehicle 12 may be made to coincide with the center line of the strip 10 of material to be compacted.

Similarly, but an appropriate selection of the reduction ratio of the power transmission 23 on the guide vehicle 12 the speed of the latter may be determined as a function of the angular velocity of the compacting machine about the guide vehicle, i.e., the velocity of the compacting machine taking account of the length of the path of travel.

The selection of the reduction ratio determines the number of compacting passes of the compacting machine 12 per linear meter of compacted material, the number of passes then remaining constant throughout the displacement of the guide vehicle 12.

Figure 3:
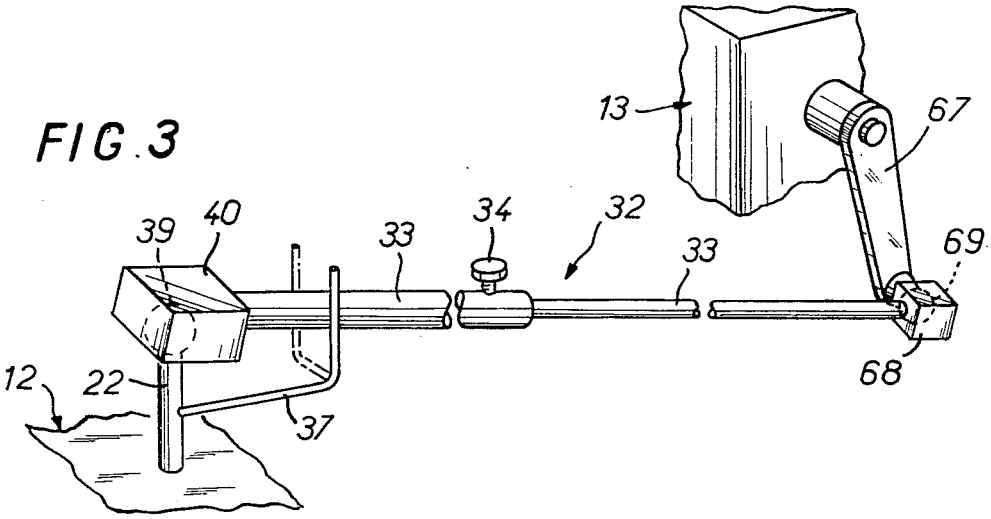
FIG. 3 is an enlarged detail, in perspective, of the coupling bar interconnecting the compacting machine with the guide vehicle therefor.

In conformity with an arrangement shown diagrammatically in chain-dotted lines in FIG. 3, the crank 37 may be bifurcated.

Figure 9:
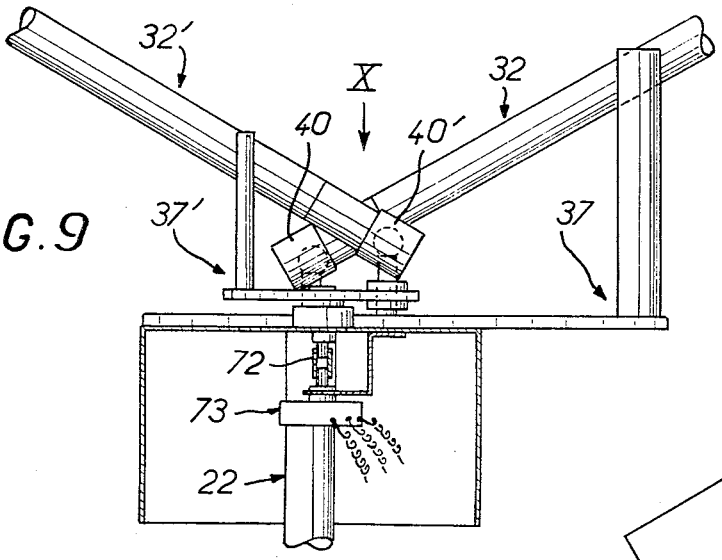
FIG. 9 is a fragmentary elevational view on an enlarged scale, showing the association of a plurality of compacting machines with a single guide vehicle.
Figure 10:
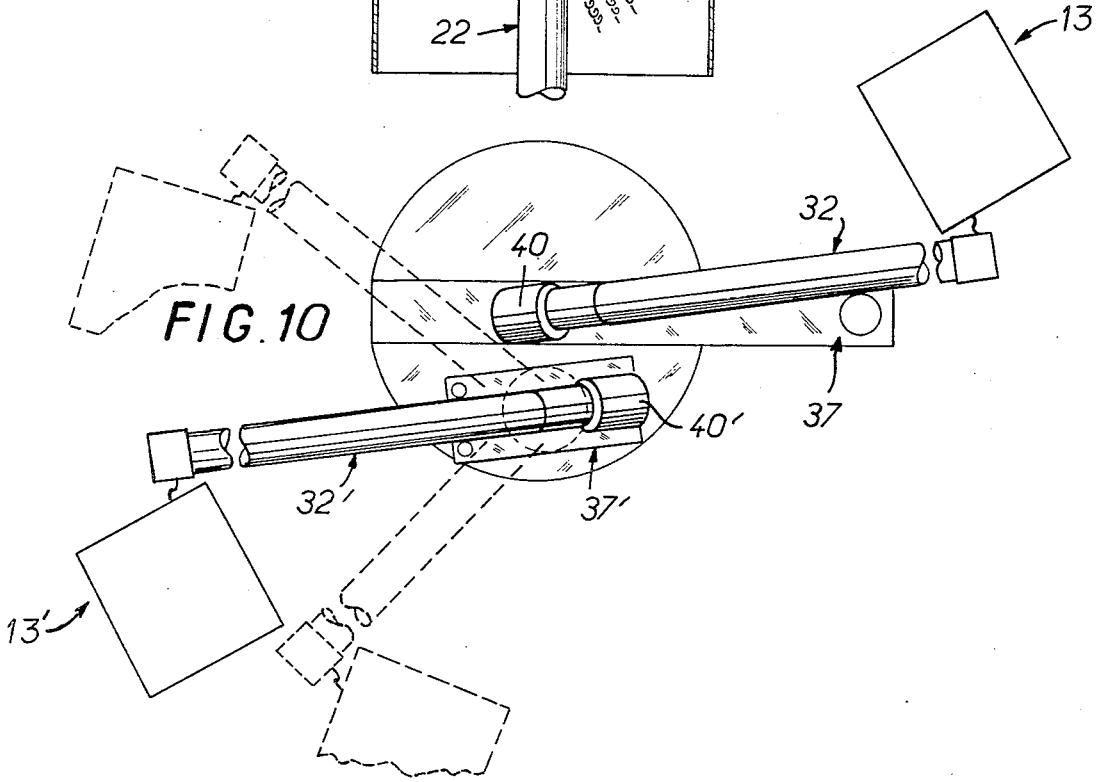
FIG. 10 is a plan view of the arrangement shown in FIG. 9, viewed in the direction of arrow X therein.

In accordance with a modified embodiment diagrammatically shown in FIGS. 9 and 10, there is provided at least one other similar compacting machine which likewise is distinct from and arranged for orbital motion around the same guide vehicle 12. The compacting machine 13 hereinafter referred to as the master compacter, is represented only by a box connected to its coupling bar 32. The other compacting machine 13', referred to as a slave compacter, is represented only by a box connected to its coupling bar 32' which according to the arrangement of the coupling bar 32 is also associated with the guide vehicle 12 for controlling the direction of displacement thereof.

By the provision of means which are within the skills of one having ordinary skill in the art, the speed control of the slave compacter so constructed is preferably linked to that of the master compacter. For example, as illustrated, a bifurcated crank 37' is associated with the coupling bar 32' of 13' the slave compacter, which bifurcated crank 37' is freely rotatable with respect to the crank 37 associated with the coupling bar 32 of the master compacter 13 and therefore is not able to rotatably drive the driving shaft 20 of the guide vehicle but instead is fixed for rotation with the spindle 72 of an adjustable resistor or rheostat 73 fixed on the crank 37.

The rheostat thus reads the angulr separation between the coupling bars 32 and 32' and the corresponding data may, in accordance with arrangements within the skills of the workman in the art, be transmitted to a speed control unit for the slave compacter which permits, without over-damping, the maintenance of a substantially constant angular separation between the coupling bars 32 and 32' by controlling a suitable speed correction of the slave compacter when the angular separation varies and therefore maintains the angular separation between the slave compacter and the master compacter substantially constant.

Of course a plurality of such slave compacters 13' may be provided.

The present invention is, moreover, not limited to the described and illustrated embodiment and modifications but encompasses all variations, expedients and/or combinations thereof within the purview of the appended claims.

In particular the steering of the guide vehicle 12 may be guided with reference to the left-hand edge of the strip being compacted. Also, when the guide vehicle is steered to one side only the reference line may be a guide line or cable customarily associated with the compacting machine.

Furthermore, the power transmission for the guide vehicle 12 may also be a gear box and cone pulleys, with a preference, as mentioned above, for a speed variator or PIV drive.

The guide vehicle 12 may, in addition, be equipped with its own engine or motor to make it self-propelled and/or be for a structure different from that as shown and described.

Further, the steering control means for the compacting machine may be as disclosed in the foregoing U.S. patent instead of with the coupling bar described herein. In this case the coupling bar, ensuring the advance of the guide vehicle when it is not self-propelled, is not necessarily linked to the compacting machine which turns it. Instead, it may be free of all connections with the compacting machine other than merely contacting projections on its body, the coupling bar and the projection, moreover, simply resting against the body.

Likewise, in this case, the guide vehicle coupling bar may be in free sliding engagement with inverted U-section keyed to the driving shaft of the guide vehicle.

Finally, the steering system for the guide vehicle is itself capable of numerous constructional modifications.

Furthermore, and as it will have been understood, in the illustrated embodiment the ball member for coupling the coupling bar to the guide vehicle and the compacting machine are sufficient to systematically take up and potential relative vertical movements between the guide vehicle and the compacting machine, while the coupling bar is preferably rigid or semirigid.

What we claim is:

1. In an apparatus for compacting or consolidating a strip of road surfacing material of the type including self-propelled compacting machine having a steering mechanism, and a guide vehicle having a set of drive wheels displaceable along a strip of surfacing material to be compacted or consolidated, said guide vehicle having a driving shaft and transmission means for transmitting torque from said driving shaft to said drive wheels of said guide vehicle; the improvement comprising a substantially rigid coupling bar for guiding said compacting machine for orbital movement about said guide vehicle, one end of said coupling bar being connected to said driving shaft on said guide vehicle for rotating said driving shaft in response to the orbital movement of said compacting machine about said guide vehicle, a crank provided on said compacting machine, the other end of said coupling bar adjacent said compacting machine being articulated to said crank, said crank being coupled to said steering mechanism of said compacting machine for controlling said steering mechanism whereby the radius of the orbital movement of the compacting machine is automatically maintained constant throughout operation.

2. Improvement according to claim 1, said one end of said coupling bar being connected to said driving shaft by first ball joint means and said other end of said coupling bar being connected to said crank by second ball joint means.

3. Improvement according to claim 1, wherein horizontal support means and vertical abutment means are in contact with said coupling bar at its one end adjacent of said guide vehicle, and another crank is interposed in a path of movement of said one end of said coupling bar and coupled to said driving shaft of said guide vehicle so as to impart rotating movement to said driving shaft in response to rotation of said coupling bar.

4. Improvement according to claim 3, wherein said horizontal support means and said vertical abutment means for said coupling bar constitute coupling joint means permitting free rotation of said coupling bar at least in a horizontal plane perpendicular to the axis thereof.

5. Improvement according to claim 1, wherein said coupling bar is of telescopic construction, and further includes releasable locking means for fixing the desired length of said coupling bar and thereby the turning radius of said compacting machine about said guide vehicle.

6. Improvement according to claim 1, together with a second compacting machine associated with said first mentioned compacting machine and distinct from said guide vehicle and arranged for orbital movement thereabout, and another of said coupling bars connected between said second compacting machine and said guide vehicle.

7. Improvement according to claim 6, wherein said first mentioned compacting machine is a master compacter and said second compacting machine a slave compacter, and there are speed control means for said slave compacter controlled by said master compacter.

8. Improvement according to claim 7, wherein said speed control means for said slave compacter includes an adjustable resistor fixed with respect to said first mentioned crank, said other crank being operable to displace a movable contact for said adjustable resistor whereby said adjustable resistor gives a reading of the angular separation of said cranks.

* * * * *